US008701256B2

(12) United States Patent
Mars

(10) Patent No.: US 8,701,256 B2
(45) **Date of Patent: *Apr. 22, 2014**

(54) REMOVING MATERIAL FROM SURFACES OF METALS PROCESSING CHAMBERS

(75) Inventor: Aaron P. Mars, Schaghticoke, NY (US)

(73) Assignee: Mars Metals, Inc., Schaghticoke, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/445,963

(22) Filed: Apr. 13, 2012

(65) Prior Publication Data

US 2012/0192896 A1 Aug. 2, 2012

Related U.S. Application Data

(60) Continuation of application No. 13/324,465, filed on Dec. 13, 2011, now Pat. No. 8,156,623, which is a division of application No. 12/054,950, filed on Mar. 25, 2008, now Pat. No. 8,099,844.

(60) Provisional application No. 60/908,093, filed on Mar. 26, 2007.

(51) Int. Cl.
*B21B 45/04* (2006.01)

(52) U.S. Cl.
USPC ..... 29/81.01; 29/81.021; 29/81.06; 134/2; 134/7; 134/6; 134/22.12; 134/41; 134/84; 134/92; 134/93; 134/131; 134/137; 134/144; 134/200; 266/135; 266/136; 15/3; 15/3.5; 15/318; 15/322; 15/301

(58) Field of Classification Search
USPC ..... 29/81.01, 81.021, 81.06; 134/7, 198, 134/200, 84, 92, 93, 131, 137, 144, 22.12, 134/41, 2, 6; 15/3, 3.5, 318, 322; 266/135, 266/136
See application file for complete search history.

(56) References Cited

U.S. PATENT DOCUMENTS 7,544,254 B2 * 6/2009 Buccos ..... 134/21
8,156,623 B1 * 4/2012 Mars ..... 29/81.01

* cited by examiner

*Primary Examiner* — Peter DungBa Vo
*Assistant Examiner* — Azm Parvez
(74) *Attorney, Agent, or Firm* — Tech Valley Patent, LLC; John Pietrangelo

(57) ABSTRACT

Methods and apparatus for removing condensed metal from the surfaces of metal processing chambers, such as, vacuum induction melting (VIM) furnaces having, for example, condensed Mg or Ti, are disclosed. The methods and apparatus provide a robotic arm end positioned in the furnace having a nozzle operatively connected to a source of dry ice. The robotic arm end directs a stream of dry ice particles against the surface of the furnace to displace condensed metal. The displaced metal is collected for reuse or disposal. Aspects of the invention provide a safe and automated process for cleaning process chambers and recovering metal that can typically be dangerous when performed by conventional methods.

20 Claims, 1 Drawing Sheet

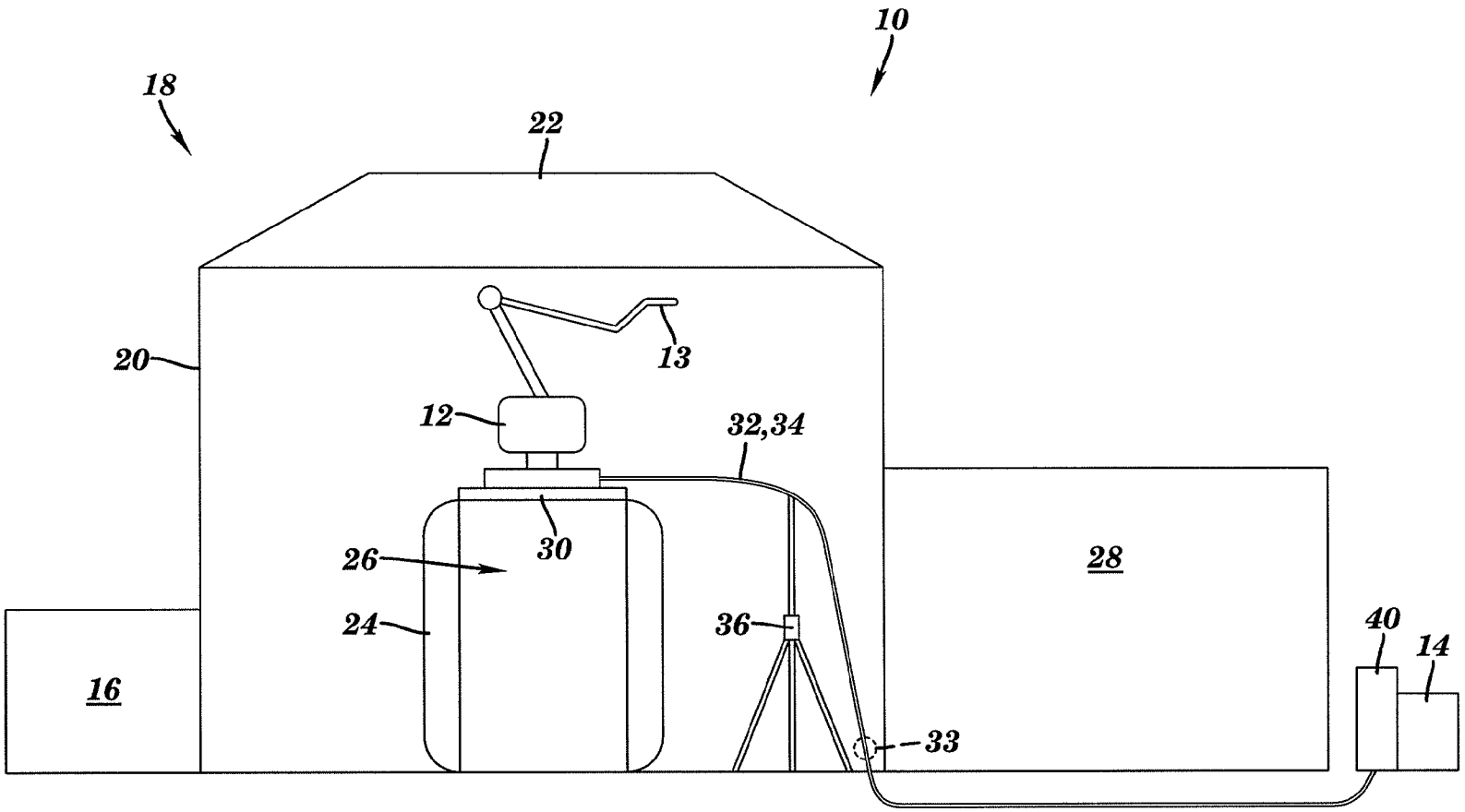
10
18
22
20
13
12
30
26
24
32,34
36
33
28
40
14
16

REMOVING MATERIAL FROM SURFACES OF METALS PROCESSING CHAMBERS

CROSS-REFERENCE TO RELATED APPLICATIONS

This application is a continuation application of U.S. application Ser. No. 13/324,465 filed on Dec. 13, 2011, now U.S. Pat. No. 8,156,623, which is a divisional application of U.S. application Ser. No. 12/054,950 filed on Mar. 25, 2008, now U.S. Pat. No. 8,099,844, which claims priority from U.S. Provisional Patent Application 60/908,093, filed on Mar. 26, 2007, the disclosures of which are included by reference herein in their entirety.

BACKGROUND

1. Field of the Invention

The present invention relates to the recovery of condensed metal from metal processing furnace, and more particularly, to methods and apparatus for directing a stream of dry ice against a surface of a processing chamber to displaced metal condensed on the surface.

2. Description of Related Art

The Super Alloy industry manufactures numerous types of alloys utilized primarily in the aerospace industry. Many super alloys contain relatively high percentages of magnesium (Mg), as well as, chromium (Cr), cobalt (Co), and cadmium (Cd). Magnesium is a very light, silver-grey metal that tarnishes slightly in air. When finely divided into powders or dusts, magnesium readily ignites upon heating in air and burns with a dazzling white flame. Normally, magnesium is coated with a layer of oxide (for example, MgO) that protects it from reacting with air and/or water.

Magnesium-containing alloys are typically manufactured in Vacuum Induction Melting (VIM) furnaces, under vacuum, in the absence of oxygen and moisture. While these furnaces may have slightly different configurations, they generally have four basic components: a Main Chamber, where melting occurs; a Dome, that is, an area over the main chamber—often the top of the dome is 18-30 feet high and may retract to allow overhead cranes to move the crucible in and out of the furnace; a Crucible, that is, the pot that alloys are actually mixed and melted in; and a Stanchion, that is, the mechanism that locks the crucible in place and physically lifts, tips, and pours the liquid metal into, for example, molds. Further features of a VIM furnace are described in an online materials processing database that appears at http://www.azom.com/details.asp?ArticleID=1505, which is incorporated by reference herein.

As the metal, for example, a super alloy, such as, magnesium, and other components of the alloy are melted at temperatures that exceed 2800 degrees F., a vapor is produced that upon contact with the furnace dome and walls, hardens into a brittle material that the industry often refers to as "condensate." The magnesium portion of this condensate is not coated with the layer of oxide that normally protects the magnesium from reacting with air or moisture. As a result, the condensate is typically very reactive and prone to creating fires. If the condensate is not regularly removed from the VIM furnace, the condensate may flake off and fall into the pots of melting alloy and cause the resulting batch of alloy to be "off spec" and unusable for its intended purpose. The safe removal of magnesium-containing condensate has plagued the industry for years.

Prior Art Methods of Condensate Removal

In the past, three primary methods of condensate removal have been employed: Burn Off, $CO_2$ Blasting, and Manual cleaning.

- Burn Off: Burn off is the process of releasing the vacuum in the VIM and introducing oxygen into a furnace at melting temperature. The introduction of oxygen results in the magnesium igniting and burning off. This method is typically minimally effective. Since the burn off is typically surficial in nature, a significant amount of the reactive magnesium is often unaffected, and still present in the furnace.
- $CO_2$ Blasting: The use of solid $CO_2$, or dry ice, blasting has been used successfully for the removal of magnesium-containing condensate for a number of years. The dry ice is used as an abrasive blast medium that is delivered under high air pressure. The dry ice typically "explodes" upon impact with the condensate and the furnace substrate and sublimates. An added benefit to the use of dry ice as a blast medium is that the sublimated $CO_2$ gas displaces the oxygen in the area and helps reduce the likelihood of fire. This is significant in that, during the dry ice blasting, the condensate may be broken into a fine dust that is potentially pyrophoric (that is, capable of igniting spontaneously in air).
- While effective, the dry ice blasting method requires the individual performing the work to do so with supplied breathing air equipment to prevent the inhalation of high concentrations of metal dust and to ensure an adequate oxygen level to support life and health. The supplied breathing air equipment also inhibits mobility in the event of an emergency. Moreover, the amount of dust generated during this operation greatly reduces visibility, and, in the event of either a fire or explosion, presents a real obstacle for an emergency evacuation of the furnace work area.
- Manual Cleaning: Manual cleaning of VIM furnaces requires that individuals enter the furnace and use non-sparking tools to physically scrape the condensate from the walls and ceiling of the furnace. While this method is very effective, it is also the most dangerous. It still requires the use of supplied breathing air equipment and, even when using non-sparking tools, the friction generated during the scraping process routinely ignites the magnesium component of the condensate and generates fire. A number of individuals performing this manual operation have received severe burns while doing so.

Due to the shortcomings and disadvantages of the prior art, there is a need in this art to provide a safe, effective system for removing condensate from VIM furnaces and related furnaces. In fact, failing to locate such a system in the industry, one leading supplier of super-alloy approached the present inventor and requested that the applicant develop and provide such a system. Aspects of the present invention provide the desired system, which has had a long-felt, but unmet need in the materials handling industry.

BRIEF SUMMARY OF THE INVENTION

One aspect of the invention is a method for removing condensed metal from a surface of a metal processing chamber, such as, a furnace, for example, a vacuum induction metal (VIM) furnace. The method includes positioning a robot having arm end into the metal processing chamber; providing the arm end of the robot with a source of dry ice; directing a flow or stream of dry ice against the surface of the metal processing chamber to displace at least some material from the surface;

and collecting at least some of the displaced material. In one aspect, the material displaced may be Mg-containing material in a Mg processing device, for example, a VIM furnace handling Mg. In another aspect, the material displaced may be a titanium (Ti)-containing material (such as, $TiO_2$ or TiO) in a Ti processing device, for example, a VIM furnace handling Ti. In another aspect, the robot may be an articulating robot having an articulating arm and an arm end mounted to the articulating arm. In another aspect, the robot may be an articulating nozzle, for example, a robot arm end having an articulating nozzle. The source of dry ice may comprise a dry-ice delivery system, for example, a dry ice blasting system providing dry ice particles under pressure. In another aspect, collecting at least some of the displaced material may comprise drawing the displaced material from the chamber, and may include isolation of the displaced material from the flow of gases, typically air, drawn from the chamber.

Another aspect of the invention is an apparatus for removing condensed metal from a surface of a metal processing chamber, such as, a furnace, for example, a VIM furnace. The apparatus includes a robot having arm end positioned in the metal processing chamber; a source of dry ice operatively connected to the arm end; means for directing a flow of dry ice against the surface of the metal processing chamber to displace at least some material from the surface; and a displaced material collection system operatively connected to the chamber. In one aspect, the material may be condensed Mg-containing material in a Mg processing device, for example, a VIM furnace handling Mg. In another aspect, the material displaced may be a Ti-containing material in a Ti processing device, for example, a VIM furnace handling Ti. In another aspect, the robot may be an articulating robot having an articulating arm and an arm end mounted to the articulating arm. In another aspect, the robot may be an articulating nozzle, for example, a robot arm end having an articulating nozzle. The source of dry ice may comprise a dry-ice delivery system, for example, a dry ice blasting system. In another aspect, the displaced material collection system may comprise means for drawing the displaced material from the chamber, and may include means for isolating the displaced material from the flow of gases, typically air, drawn from the chamber.

These and other aspects, features, and advantages of this invention will become apparent from the following detailed description of the various aspects of the invention taken in conjunction with the accompanying drawing.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

FIG. 1 is a schematic view of an apparatus for removing condensed metal from a surface of a metal processing chamber according to one aspect of the invention.

DETAILED DESCRIPTION OF ASPECTS OF THE INVENTION

The present inventor has developed a method and an apparatus for providing an automated (for example, robotic) cleaning system to remove condensate from the surfaces of a material processing device, for example, a VIM furnace, for example, during routine furnace downtime. The material removed or displaced may be a magnesium (Mg)- or titanium (Ti)-containing material, among other materials, in a Mg or Ti processing device, for example, a VIM furnace. This method and apparatus may be practiced remotely, that is, with no personnel positioned inside the chamber being treated. Though the following discussion will describe aspects of the invention as they apply to VIM furnaces, aspects of the invention may be applied to any surface from which a material, such as, a condensed material, is to be removed, for example, paint, concrete, and ice, among other materials.

One aspect of the invention includes three components: (1) an intrinsically safe industrial robot; (2) carbon dioxide ($CO_2$) blasting equipment; and (3) a dust collection system, for example, a dust collection system designed specifically to handle pyrophoric metal dust. One aspect of the invention is illustrated schematically in FIG. 1.

FIG. 1 illustrates a system 10 including an industrial robot 12; $CO_2$ blasting equipment 14; and a dust collection system 16. System 10 is associated with a VIM furnace 18 having a main vessel or chamber 20, a dome 22, a crucible 24, a stanchion 26, and a mold chamber or room 28, as is conventional. The robot 12 typically includes an arm-end 13 and the $CO_2$ blasting equipment 14 provides a source of dry ice to arm end 13 of robot 12. Arm end 13 typically may include one or more nozzles adapted to discharge dry ice.

According to the prior art, one hurdle to be overcome when using a robot 12 to clean the dome 22 and main chamber 20 of the VIM furnace 18 is the height of dome 22 and access to dome 22 and chamber 20. For example, the majority of the space in main chamber 20 is typically dedicated to the stanchion 26 and the crucible 24, leaving little or no room for conventional mounting of a robot. For this reason, in one aspect, robot 12 may be mounted on top of crucible 24 while it is locked into stanchion 26. A mounting or base plate 30, for example, a two-inch thick steel plate with lock bolts, may be provided to secure robot 12 to the top of crucible 24. Robot 12 or arm end 13 may also be mounted on a support structure, for example, a "dummy crucible," to position arm end 13 at the elevation desired. Robot 12 or arm end 13 may also be mounted on a hydraulic lift to position arm end 13 at the elevation desired.

The base plate 30 may include robot mounting hardware connected to an electronic servo motor (not shown) or turntable capable of rotating the entire robot 12 at least 60 degrees, for example, at least 180 degrees, in either direction, that is, clockwise or counter-clockwise when viewed from above. In one aspect, this may be desirable because robot 12 may be capable of limited rotation, for example, the robot 12 may be adapted to rotate only about 300 degrees of rotation, and only provides full coverage for 180 degrees. The robot 12 may be a six-axis robot having a 1 to 6 meter reach, for example, a robot having about a 2.8-meter reach.

The method of programming robot 12 may be provided by mimicking the desired motion of robot 12 by constructing a scale mockup of the installation, for example, a mockup of chamber 20 and/or dome 22. This mockup may be provided off site with final programming developed once the system 10 is installed in a desired location. In one aspect, the programming of robot 12 may require that all surfaces of the dome 22 are dry ice blasted keeping the nozzle of the dry ice blaster no more than three inches from the surface of dome 22 and the walls of furnace chamber 20.

Many types and varieties of conventional articulating or gantry-type robots may be used in system 10. However, due to the unique pyrophoric atmosphere of some aspects of the invention, robot 12 must be specifically designed to withstand the conditions, for example, vacuum and pyrophoric materials. For example, the applicant discovered that no available industrial robots are available from the leading robot suppliers that could be certified for use in the present invention. One leading robot supplier was required to specifically certify a robot for use in the environment of the present invention. In one aspect of the invention, robot 12 may comprise a robot provided by ABB, for example, an IRB 5400-02 robot, or its equivalent. ABB brochure PR 10091EN_R1 containing specifications for the ABB IRB 5400-02 robot is incorporated by reference herein.

In one aspect of the invention, for example, when space between crucible 24 and dome 22 is limited, robot 12 may not be a conventional robot, but may simply be a nozzle adapted to be articulated to direct the dry-ice stream as desired. For example, robot 12 may comprise a robot wrist assembly mounted to crucible 24, for example, mounted to base plate 30, having one or more nozzles adapted to direct a stream of dry ice against dome 22 or chamber 20.

According to one aspect, robot 12 may be placed on top of crucible 24 while crucible 24 is positioned outside of furnace chamber 18. In another aspect, when space is available, robot 12 may be mounted to crucible 24 while crucible 24 is positioned within chamber 18. Once mounted, robot 12 and crucible 24 may be moved into place within chamber 18 using an overhead crane (not shown). The crucible 24 may be locked into stanchion 26, and robot controller cables 32 and $CO_2$ blasting conduits or hoses 34 may be manually routed into furnace chamber 18, for example, through the mold chamber 28 or other adjacent chamber, or through one or more access ports 33 designed to pass cables 32 and conduits 34. The cables 32 and conduits 34 may be placed on stands 36 to keep them off the floor, which may be prone to catch on fire during the cleaning process, and the connections made to robot 12. A robot controller 40 may be provided, for example, outside of chamber 18. Controller 40, for example, a controller provided by ABB or its equivalent, may be capable of controlling all aspects of the cleaning process, including operation of $CO_2$ blasting equipment 14, and dust collection system 16. The robot controller 40 may also monitor and evaluate the status of built-in safeguards, such as, proximity and flow sensors for the $CO_2$ blasting equipment 40 and dust collection system 16. All operational and performance parameters and information may be monitored and recorded and made available for review and adjustment, as necessary, for example, at the user interface of controller 40. Safety interlocks may also be provided, for example, including automatic shutdown in the event of a low flow condition or malfunction in robot 12, dust collector system 16, and/or in $CO_2$ blasting system 14.

In one aspect, the ductwork or conduits for dust collection system 16 may be mounted, for example, permanently mounted, at convenient locations, for example, to a pickup location near the internal entrance to the mold chamber 28 and in the main chamber 20. The dust collection system 16 may typically include an air-moving device, for example, a fan or blower, to push or draw dust from chamber 20 and/or chamber 28. Dust collection system 16 may be designed specifically to deal with the collection of pyrophoric metal dust. Collection system 16 may be capable of serving two functions to the facility having system 10. For example, during the robotic cleaning operations, collection system 16 may prohibit the accumulation of heavy concentrations of dust that could result in an explosion. In addition, collection system 16 may enable the facility to evacuate dust from the furnace chamber 18, for example, from main chamber 20 or mold chamber 28, prior to opening any chamber or combination of chambers to atmosphere. Both of these functions may greatly reduce the exposure of personnel and equipment to harmful metal dust, and help to keep the facility clean.

Many types and varieties of conventional dust collection systems may be used in system 10. In one aspect of the invention, dust collection system 16 may comprise a dust collection system provided by American Air Filter International, for example, a RotoClone hydrostatic precipitator, or its equivalent. The specifications for an American Air Filter (AAF) Type N RotoClone (for example, a size 4, arrangement C) hydrostatic precipitator that may be used in system 10 are provided in AAF brochure APC-1-511T (November 2006), which is incorporated by reference herein.

The initiation and cessation of the dust collection system may be handled by the robot controller 40. Safety interlocks and flow devices may be established to ensure that robot 12 and ice blaster system 14 are shutdown in the event the dust collection system 16 malfunctions or unexpectedly comes off-line. Dust collection system 16 may be equipped with an automatic sludge removal system and internal flow control devices to ensure that proper water levels are maintained in dust collection system 16, for example, at all times.

The dry ice blast equipment 14 may be equipped with two nozzles: one standard fan nozzle capable of performing general cleaning, and one nozzle capable of 90-degree rotation to access and clean the horizontal surfaces not accessible by the standard fan nozzle. The dry ice blast equipment 14 may be mobile and may be staged directly outside of the furnace chamber 18 during the cleaning operation. Dry ice blast equipment 14 may typically require manual addition and monitoring of the dry ice medium in the unit hopper. All aspects of the operation and performance of dry ice blast system 14 may be controlled through the robot controller 40 and its user interface.

Many types and varieties of conventional $CO_2$ (that is, dry ice) blasting equipment may be used in system 10. Again, due to the unique pyrophoric atmosphere of some aspects of the invention, $CO_2$ blasting equipment 14 may be specifically designed to withstand the conditions, for example, vacuum and pyrophoric materials. For example, the applicant discovered that no available $CO_2$ blasting equipment is available from the leading suppliers that could be certified for use in the present invention. One $CO_2$ blasting equipment supplier was required to specifically certify $CO_2$ blasting equipment for use in the environment of the present invention. In one aspect of the invention, $CO_2$ blasting equipment 14 may comprise a system provided by ColdJet, for example, a ColdJet single-hose dry ice blast system, or its equivalent. The specification for a ColdJet AeRO 75 DX dry ice blast system that may be used in system 10 is incorporated by reference herein.

Once the cleaning of chamber 20 and dome 22 is complete, dome 22 may be opened, all cables (for example, hoses and cables 32, 34) may be removed, and robot 12 and crucible 24 may be removed from furnace 18 and staged or stored for future use.

As described above, aspects of the present invention provide methods and apparatus for removing condensed metal from the surface of metal processing chambers. These methods and apparatus allow plant operators to automatically and safely clean process chambers and equipment without exposing plant personnel and equipment to the hazards typically associated with chamber cleaning processes. In addition, aspects of the invention capture hazardous particulate to minimize or prevent exposure to personnel, equipment, and the environment.

While several aspects of the present invention have been described and depicted herein, alternative aspects may be effected by those skilled in the art to accomplish the same objectives. Accordingly, it is intended by the description above cover all such alternative aspects as fall within the true spirit and scope of the invention.

The invention claimed is:

1. An apparatus for removing material containing condensed metal from a surface of a metal processing chamber, the apparatus comprising: an articulating nozzle positioned in the metal processing chamber; a source of dry ice operatively connected to the articulating nozzle; means for directing a flow of dry ice against the surface of the metal processing chamber with the-articulating nozzle to displace at least some material containing condensed metal from the surface; and a displaced material collection system operatively connected to the chamber.

2. The apparatus as recited in claim 1, wherein the processing chamber comprises a furnace.

3. The apparatus as recited in claim 2, wherein the furnace comprises a vacuum induction-melting (VIM) furnace.

4. The apparatus as recited in claim 1, wherein the condensed metal comprises at least one of an Mg-containing material and a Ti-containing material.

5. The apparatus as recited in claim 1, wherein the articulating nozzle positioned in the chamber comprises an articulating nozzle positioned above a crucible in the chamber.

6. The apparatus as recited in claim 5, wherein the apparatus further comprises a mounting plate mounted to the crucible, the mounting plate adapted to support the articulating nozzle.

7. The apparatus as recited in claim 1, wherein the displaced material collection system comprises means for drawing at least some of the displaced material from the chamber.

8. The apparatus as recited in claim 7, wherein the means for drawing at least some of the displaced material from the chamber comprises means for drawing at least some of the displaced material and gases from the chamber, and wherein the apparatus further comprises means for isolating at least some of the displaced material from the displaced material and gases drawn from the chamber.

9. The apparatus as recited in claim 6, wherein the mounting plate comprises a turntable.

10. The apparatus as recited in claim 1, wherein the articulating nozzle is positioned on a support structure in the metal processing chamber.

11. A method for removing material containing condensed metal from a surface of a metal processing chamber, the method comprising: positioning an articulating nozzle into the metal processing chamber; providing the articulating nozzle with a source of dry ice; directing a flow of dry ice against the surface of the metal processing chamber with the articulating nozzle to displace at least some material containing condensed metal from the surface; and collecting at least some of the displaced material.

12. The method as recited in claim 11, wherein the processing chamber comprises a furnace.

13. The method as recited in claim 12, wherein the furnace comprises a vacuum induction-melting (VIM) furnace.

14. The method as recited in claim 11, wherein the condensed metal comprises at least one of an Mg-containing material and a Ti-containing material.

15. The method as recited in claim 11, wherein providing the articulating nozzle with a source of dry ice comprises providing the articulating nozzle with a source of dry ice particles under pressure.

16. The method as recited in claim 11, wherein collecting at least some of the displaced material comprises drawing at least some of the displaced material from the chamber.

17. The method as recited in claim 11, wherein positioning the articulating nozzle comprises positioning the articulating nozzle above a crucible in the metal processing chamber.

18. The method as recited in claim 17, wherein positioning the articulating nozzle above the crucible comprises mounting a plate on the crucible and operatively mounting the articulating nozzle above the plate.

19. The method as recited in claim 11, wherein positioning the articulating nozzle into the metal processing chamber comprises positioning the articulating nozzle on a support structure in the metal processing chamber.

20. The method as recited in claim 19, wherein positioning the articulating nozzle on the support structure comprises positioning the articulating nozzle on a dummy crucible.

* * * * *